United States Patent [19]

Schulte

[11] Patent Number: 4,519,296

[45] Date of Patent: May 28, 1985

[54] CONTROL-CIRCUIT THROTTLE VALVE

[75] Inventor: Heinz Schulte, Marktheidenfeld, Fed. Rep. of Germany

[73] Assignee: G. L. Rexroth GmbH, Lohr, Fed. Rep. of Germany

[21] Appl. No.: 608,265

[22] Filed: May 8, 1984

Related U.S. Application Data

[63] Continuation of Ser. No. 265,661, May 20, 1981.

[30] Foreign Application Priority Data

May 20, 1980 [DE] Fed. Rep. of Germany ..... 3019257

[51] Int. Cl.[3] ..... F15B 13/16

[52] U.S. Cl. ..... 91/388; 251/209

[58] Field of Search ..... 251/205, 209, 215; 91/388

[56] References Cited

U.S. PATENT DOCUMENTS

| | | | |
|---|---|---|---|
| 1,967,851 | 7/1934 | Wilson | 251/215 |
| 3,198,479 | 8/1965 | Greenwood | 251/205 |
| 3,215,045 | 11/1965 | Lissau | 91/388 |
| 3,433,261 | 3/1969 | Fox | 251/209 |
| 4,094,229 | 6/1978 | Leonard | 91/388 |

*Primary Examiner*—Paul E. Maslousky

*Attorney, Agent, or Firm*—Oblon, Fisher, Spivak, McClelland & Maier

[57] ABSTRACT

A control-circuit throttle valve assembly coupled to and regulating a hoisting unit correcting element or final control element of a tractor via a mechanical coupling including a throttle housing, a flow restrictor throttling body shiftably mounted in the throttle housing, the throttling body having a guiding edge portion, a control conduit with a circular cross-section communicating with the throttle housing, the control conduit including a pass-through area, and a run-off conduit communicating with the throttle housing, the guiding edge portion at least partially closing off communication between the control circuit and the throttle housing through the pass-through area upon shifting of the throttling body within the throttle housing such that the pass-through area is throttled as a linear function during operation of the hoisting unit.

2 Claims, 7 Drawing Figures

CONTROL-CIRCUIT THROTTLE VALVE

This is a continuation of Ser. No. 265,661, filed May 20, 1981.

BACKGROUND OF THE INVENTION

1. Field of the Invention

The invention concerns a control-circuit throttle valve.

2. Description of the Prior Art

The throttle valve must traditionally perform two tasks: first, the pressure-medium flow must be throttled depending on the position of a lifting assembly; second, the throttle position must be capable of adapting to the control loop, i.e., must be adjustable. A throttle valve is known which performs these two functions with the flow-resistor motions being decoupled from each other. In this procedure the guiding edge of a piston controls the pass-through opening of the control channel and thus takes care of regulating the hydraulic flow for the hoisting unit of a tractor. The throttling characteristic of a throttle valve, however, on account of geometry of the pass-through cross-section and the guiding edge, is dependent on the position of the piston. A uniform displacement or a uniform rotary motion of the piston causes the regulating pressure to change non-uniformly, i.e., the regulating sensitivity of the throttle valve varies with the position of the power lift. Since the power lift is always moved uniformly, it reacts in its upper range (raised position) more sensitively than in its lower working range.

SUMMARY OF THE INVENTION

It is therefore an object of the invention to create a throttle valve which possesses a constant sensitivity over the entire working range of the hoisting unit.

The coupling of the hoisting-unit correcting element to a gear unit which is adjusted to the geometry of the piston, its guiding edge, and the pass-through opening's linear rate of change in conformity with a geometric relation is achieved in accordance with the present invention by the pressure increase likewise changing linearly for a linear drive motion of the hoisting-unit correcting element. The regulating characteristic is thereby constant over the entire stroke of the hoisting-unit correcting element, i.e., the sensitivity of the throttle valve is unchanged.

The design of the guiding edge as an ellipse, i.e., as the edge of the cylinder obliquely sliced off, given a constant rotary motion of the piston, makes possible a linear rate of change of the covered or open pass-through area, without a non-linear gear element having to be inserted between the piston and the hoisting unit.

BRIEF DESCRIPTION OF THE DRAWINGS

Various objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENTS

Figure 1:
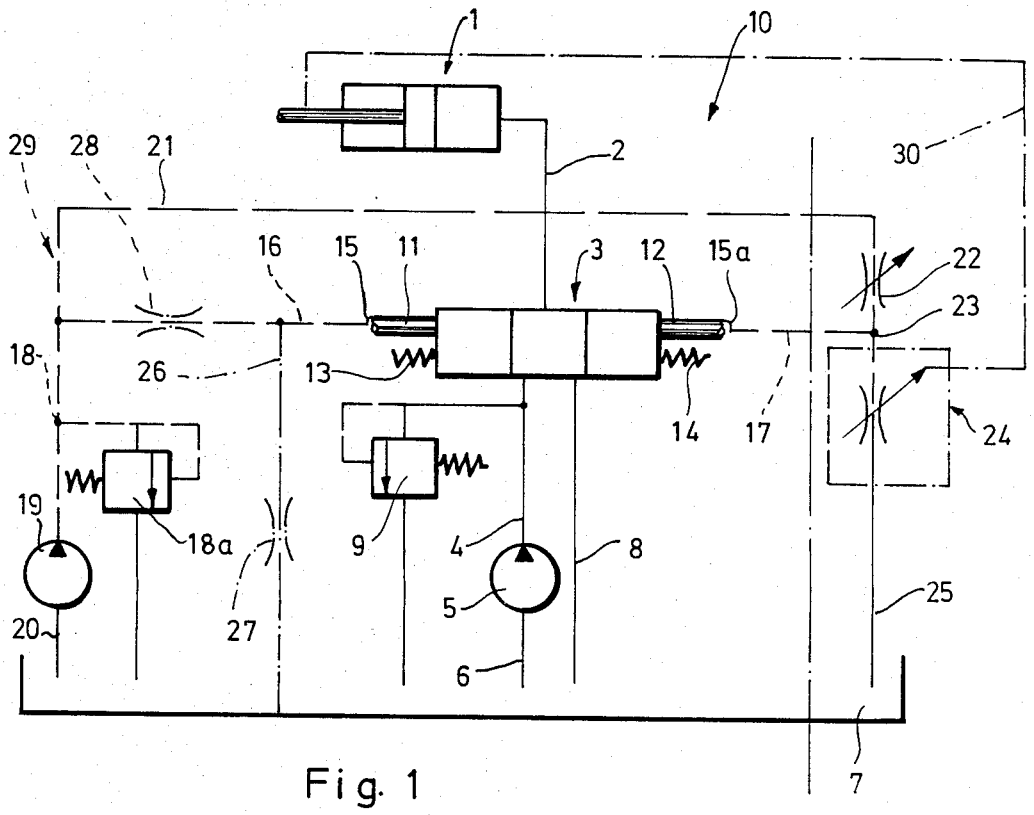
FIG. 1 is a schematic diagrammatic sketch of the regulating loop for a hydraulic correcting element with an integrated throttle valve in accordance with the invention.

FIG. 1 shows a hoisting-unit correcting element of final control element 1 activated by an operating loop 10 wherein the hoisting-unit 1 is constructed as a simple working operating cylinder, and is connected by a line 2 to a three/three directional control valve 3 which can be activated in both directions. A pump 5 is connected by a line 4 to the directional control valve 3 and the pump's suction line 6 reaches as far as a storage container 7. Storage container 7 is connected by a line 8 to the directional control valve 3. Line 4 is also connected to a pressure-relief valve 9, whose outlet side is connected to storage container 7.

Directional control valve 3 has control devices 11 and 12 placed on either side of it to activate its corresponding slide (not shown) and upon impact by a pressure medium (liquid or gas) the control devices 11 and 12 seek to displace the slide against the action of one of the control springs 13, 14, in the direction of the arrows 15, **15*a* indicated in the control device 11 or 12. When control devices 11, 12 are not impacted, two control springs 13, 14** seek to hold the slide in its middle portion.

A control line 16 is connected to control device 11, and a control line 17 to control device 12. Control line 16 is connected to a control line 18, which is connected to the pressure side of a control pump 19, whose suction line 20 is connected to storage container 7. A pressure-relief valve **18*a* is connected to control lines 18 and a control line 21 which runs to an adjusting throttle 22. From adjusting throttle 22 a control line 23 runs to a control-circuit throttle valve 24, which is connected by a line 25 with the storage container 7. Control line 23 is connected with control line 17. The control circuit is designated by reference number 29**.

Adjusting throttle 22 is constructed as a setting member and control-circuit throttle valve 24 is constructed as a standard-quantity receiver connected with the moving part of the hoisting unit 1 via a mechanical coupling 30.

A differential pressure which builds up between the two sides of directional control valve 3 due to a setting of adjusting throttle 22 causes a displacement of the directional control valve 3, whereby the correcting element 1 is displaced, with a link to an operating loop 10. Mechanical coupling 30 conducts the displacement of the correcting element 1 back to the control-circuit throttle valve 24, whereby the differential pressure between the two sides of directional control valve 3 is changed, and correcting element 1 of the hoisting unit, after repeated displacement of directional control valve 3, is separated from operating loop 10 and held in a specified regulated position.

Figure 2:
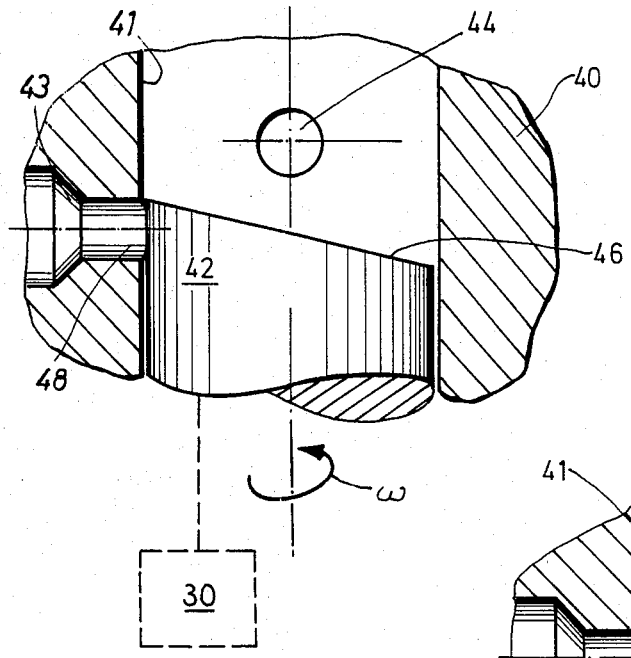
FIG. 2 is a partial sectional view of a first embodiment of the throttle valve of the invention in a first position.

FIG. 2 shows a partial sectional view of a first embodiment of the control circuit thottle valve 24. A flow restrictor piston 42 is constructed as a cylinder and is inserted in a seal-tight manner in a cylindrical bore 41 of a housing 40. Throttle valve 24 has a control conduit 43 and a run-off conduit 44, which are constructed as circular bores. Piston 42 is connected via a flat linear gear unit or other conventional mechanical coupling 30 with the hoisting-unit correcting element 1, so that the stroke of the hoisting-unit 1 is transformed into a proportional rotary motion, limited to about 90°, of piston 42, with a constant (uniform) angular velocity of $\omega$.

Figure 3:
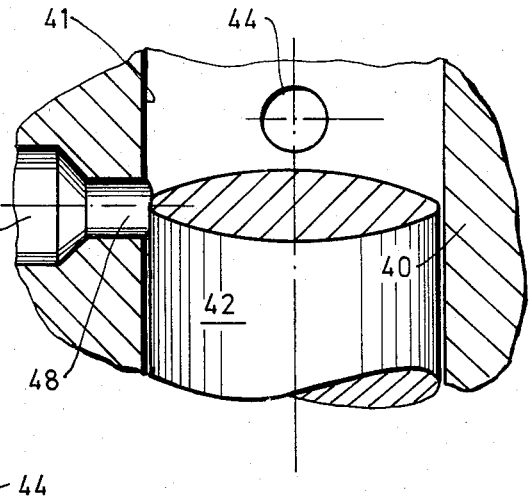
FIG. 3 is a partial sectional view of the first embodiment of the throttle valve of FIG. 2, in a second position.

FIG. 2 shows piston 42 in its topmost position, in which it completely closes off control conduit 43 with its guiding edge 46. Piston 42 is beveled and guiding edge 46 thus forms an ellipse. When piston 42 is rotated by the flat linear gear unit, guiding edge 46 moves, and opens up a portion of the pass-through area 48 of the control conduit 43. The contour of the guiding edge 46 guarantees that the pass-through area 48 of the control conduit 43 that is opened up increases as a linear function, and the throttling effect thus decreases linearly. FIG. 3 shows piston 42 in a position rotated by 90° relative to FIG. 2 and in this position guiding edge 46 of piston 42 opens up conduit 43, e.g., 50% of the pass-through area 48 to permit fluid flow.

For the coupling of the motion of the hoisting-unit correcting element 1 and of piston 42, instead of using the flat linear gear unit 30, several types of mechanical coupling units can be utilized, for example, a conventional belt drive, a toothed-wheel gear, a rack-and-pinion gear, or a chain drive.

Figure 4:
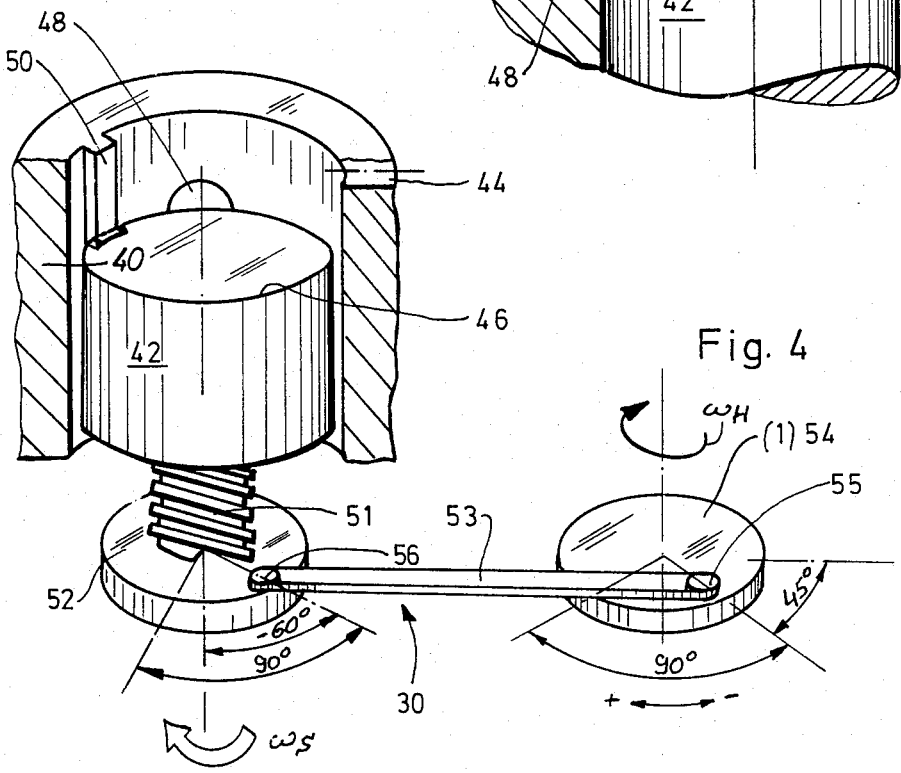
FIG. 4 is a perspective view of a second embodiment of the throttle valve of the invention with a non-linear drive.

FIG. 4 shows an additional embodiment of control-circuit thottle valve 24 of the invention. The coupling of the drive motion of the hoisting-unit correcting element 1 with piston 42 is made in this embodiment via a three-dimensional non-linear gear unit 30. For this embodiment, the straight line motion of correcting element 1 is converted into rotational motion ahead of coupling 30 by conventional means.

This gear unit 30 is composed of a non-linear crank gear and a linear worm gear. For this purpose piston 42 is secured against turning by means of a guide rail 50, and is screwed onto a spindle 51 which is permanently connected to a crank disk 52. Crank disk 52 is connected via a connecting rod 53 to another crank disk 54, which is permanently connected to the hoisting-unit correcting element 1. The crank gear is designed such that it converts a uniform rotary motion of the hoisting-unit correcting element 1 into a non-uniform rotary motion of the crank disk 52, and thereby into a non-linear stroke motion of piston 42.

FIG. 4 shows piston 42 in its lowermost position, in which it half-way controls the pass-through area 48 of control linkage 43 with its circular-shaped guiding edge 46. As shown in FIG. 4, the hoisting-unit connecting element 1 is to have a turning range of $\phi=90°$. Link points, 55 and 56, of the connecting rod 53 are placed on the crank disks 54 and 52, respectively, such a way that the peripheral velocities of link points 55 and 56 are of different magnitudes.

Figure 5:
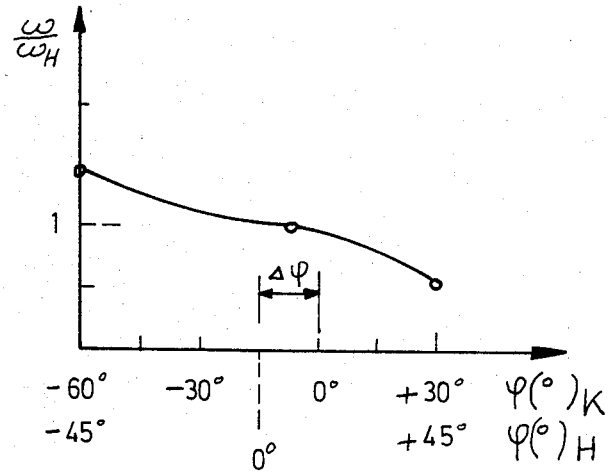
FIG. 5 is a diagram from which the angular velocities of the elevating screw and the hoisting-unit correcting element of FIG. 4 can be found.

Turning of the driving crank disk 54 of hoisting-unit correcting element 1 from $-45°$ to $+45°$ causes turning of crank disk 52 which drives the lifting spindle 51, from $-60°$ to $+30°$. A constant angular velocity $\omega_H$ of hoisting-unit correcting element 1 causes first an increased angular velocity $\omega_S$ of spindle 51, and thus a high stroke velocity of the piston 42 when the pass-through area 48 is at its maximum. Increasing rotation of crank disk 54 causes a constantly decreasing angular velocity $\omega_S$ of spindle 51, so that in the upper stroke range of piston 42 relatively small stroke motions take place when pass-through area 48 defines only a narrow circular sector. The non-linearity of the angular velocity $\omega_S$ of the lifting spindle 51 depends on the angular deflection $\phi$ of link points 55 and 56 from a parallel-crank arrangement. In the example shown, the angular deflection $\Delta\phi=\pm 15°$. Thus, there results an angular velocity progression $\omega_S$ standardized to the constant drive angular velocity $\omega_H$ as in FIG. 5, and a linear rate of change of pass-through area 48 across the entire control range of hoisting-unit correcting element 1 is obtained.

Figure 6:
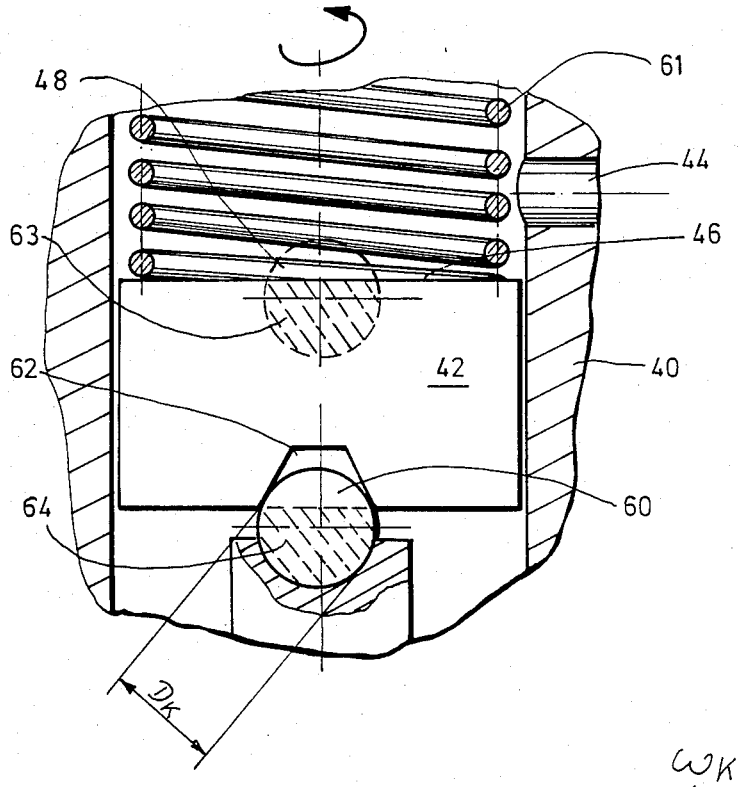
FIG. 6 is a partial sectional view of a third embodiment of the throttle valve of the invention in a first position.
Figure 7:
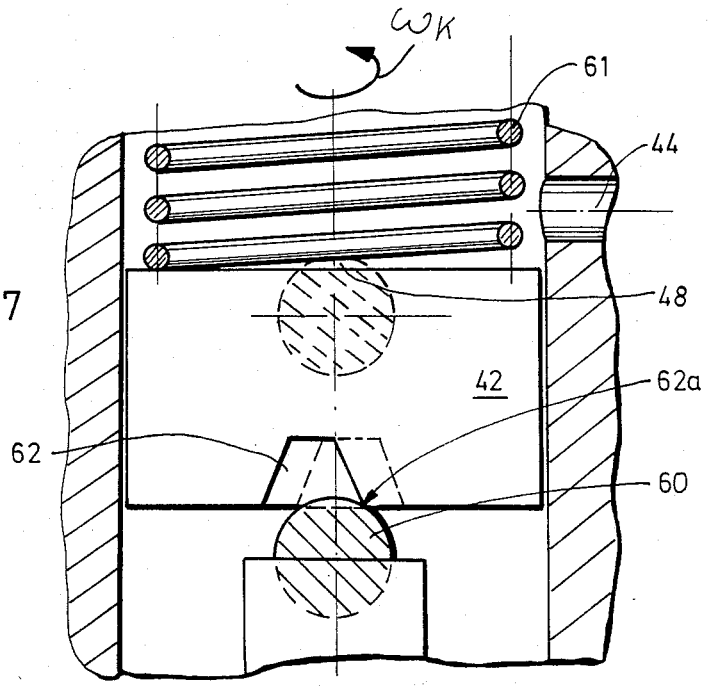
FIG. 7 is a partial sectional of the third embodiment of FIG. 6, in a second position.

FIGS. 6 and 7 show an additional embodiment, with a constant rotational drive motion of the hoisting-unit correcting element 1, for changing pass-through area 48 linearly as well. For this purpose, a cam control is used which non-linearly displaces piston 42, likewise cut off straight, with a circular guiding edge 46.

The coupling of the motion of the hoisting-unit correcting element 1 to the guiding edge 46 can be done via a suitable linear stepup gearing, which drives a cam constructed for the purpose, which displaces the piston. In the case shown, however, piston 42 itself is driven at constant angular velocity, and is supported in a cushioned fashion on a stationary eccentrically displaced cam 60. Cam 60 is inserted into an appropriately shaped depression in piston 42, so that, in being turned, the piston 42 is displaced against the force of a compression spring 61.

In the case shown cam 60 is a ball whose diameter $D_K$ corresponds to the diameter of the control linkage 43. Ball 60 is inserted into a notch 62 on the side of the piston 42 away from the guiding edge 46. The maximum insertion depth, as shown (at the lowermost operating level of the hoisting-unit) corresponds to the height of the largest possible opening of pass-through-area 48 of control linkage 43. FIG. 6 shows this connection by means of corresponding hatched area 63 and 64.

Uniform rotation of piston 42 causes an edge 62*a* of notch 62 to rest on ball 60, and thus piston 42 is displaced non-linearly upwardly in FIG. 6, in conformity with the spherical contour of ball 60. Hatched areas 63 and 64 increase synchronously and uniformly, so that the pass-through area 48 of the control linkage 43 decreases linearly with uniform rotary motion of the piston 42. The gear units described are positively force coupled, so that a contrary motion of hoisting-unit correcting element 1 causes a change in the pass-through area 48, likewise linearly, analogous to the description given above.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A control circuit throttling valve provided as a controlled dimension receiver in a hydraulic circuit for the control of a final control element, comprising:

a housing including a cylindrical bore, a run-off conduit operatively associated with said cylindrical bore and only a single control conduit having a pass through area and communicating with said cylindrical bore, said control conduit having a circular crosssection;

a single movable throttling body having the form of a piston disposed in said cylindrical bore and movable therein, said throttling body having a control surface such that movement of said throttling body controls the degree of communication between said control conduit and said run-off conduit by at least partially closing off said pass-through area through which said control conduit is in communication with said cylindrical bore;

means responsive to an operational condition of said final control element for effecting rotational movement of said single movable thottling body and for varying the magnitude of opening and closing off of said pass-through area as a linear function during rotational movement of said thottling body.

2. A control circuit throttling valve as in claim 1 wherein said means responsive to an operational condition of said final control element further comprises a mechanical coupling for transferring a uniform rotational movement to said throttling body and wherein said control surface of said throttling body further comprises an elliptical surface having an edge portion, said edge portion further comprising means for varying said pass-through area.

* * * * *